US009651327B2

(12) United States Patent
Hoon

(10) Patent No.: US 9,651,327 B2
(45) Date of Patent: May 16, 2017

(54) MEANS FOR SEMI-PERMANENTLY RETAINING THE MAGAZINE OF A SEMI-AUTOMATIC FIREARM

(71) Applicant: Douglas Martin Hoon, Guilford, CT (US)

(72) Inventor: Douglas Martin Hoon, Guilford, CT (US)

( * ) Notice: Subject to any disclaimer, the term of this patent is extended or adjusted under 35 U.S.C. 154(b) by 204 days.

(21) Appl. No.: 14/641,397

(22) Filed: Mar. 8, 2015

(65) Prior Publication Data

US 2016/0258697 A1 Sep. 8, 2016

(51) Int. Cl.
*F41A 3/66* (2006.01)
*F41A 9/61* (2006.01)
*F41A 17/38* (2006.01)

(52) U.S. Cl.
CPC ..... *F41A 17/38* (2013.01)

(58) Field of Classification Search
CPC .. F41A 17/38; F41A 17/36; F41A 9/65; F41A 9/61; F41A 3/66
USPC ..... 42/50, 6, 49.01, 18
See application file for complete search history.

(56) References Cited

U.S. PATENT DOCUMENTS 4,726,136 A * 2/1988 Dornaus ..... F41A 9/53 42/7
5,685,101 A * 11/1997 Ferretti ..... F41A 9/65 42/18
5,806,224 A * 9/1998 Hager ..... F41A 17/38 42/18
7,941,955 B2 * 5/2011 Stone ..... F41A 9/25 42/50
8,756,845 B2 * 6/2014 Harris ..... F41A 9/64 42/16
8,898,946 B1 * 12/2014 Johnson ..... F41A 9/71 42/49.02
8,904,694 B1 * 12/2014 Afuh, II ..... F41A 9/00 42/96
9,010,004 B1 * 4/2015 Fu ..... F41A 17/38 42/49.01
9,091,499 B2 * 7/2015 Overstreet ..... F41A 3/68
9,341,421 B2 * 5/2016 Findlay ..... F41A 9/65
9,417,020 B2 * 8/2016 McGinty ..... F41A 35/06
(Continued)

*Primary Examiner* — Michael David

(57) ABSTRACT

The invention comprises a device and various optional modifications to the lower receiver of a semiautomatic firearm whereby the firearm is at least semi-permanently rendered incapable of quickly removing and replacing a cartridge magazine. The device comprises a means to mechanically retain the magazine in the lower receiver of the firearm such that special tools and at least several minutes are required to remove and replace the magazine. The optional modifications comprise elimination of certain standard machined features which accept and allow the use of a magazine catch, magazine catch spring and magazine catch button; introduction of a hole or slot through the sidewall of the magazine well to accommodate a magazine retention fitting which holds the magazine in place; and the interruption of the lower portion of a clearance slot in the magazine well to prevent installation of a magazine from the bottom of the receiver. The various embodiments of this invention allow the user or manufacturer to control the time required to remove and replace a magazine over a range of approximately 3-20 minutes and the level of special tooling needed to accomplish the exchange.

17 Claims, 10 Drawing Sheets

(56) References Cited

U.S. PATENT DOCUMENTS

| | | | | |
|---|---|---|---|---|
| 9,593,897 | B2 * | 3/2017 | Larson, Jr. | F41A 17/38 |
| 2004/0020092 | A1 * | 2/2004 | Christensen | F41A 9/70 42/49.01 |
| 2010/0281737 | A1 * | 11/2010 | Cahill | F41A 9/65 42/50 |
| 2011/0067226 | A1 * | 3/2011 | Westbrook | B23B 47/28 29/559 |
| 2012/0260791 | A1 * | 10/2012 | Kerbrat | F41A 3/72 89/1.4 |
| 2014/0223790 | A1 * | 8/2014 | Wilson | F41A 9/65 42/49.01 |
| 2014/0317980 | A1 * | 10/2014 | Michel | F41A 3/66 42/6 |
| 2015/0052793 | A1 * | 2/2015 | Cassady | F41A 9/61 42/8 |
| 2015/0082678 | A1 * | 3/2015 | Jacobson | F41A 9/65 42/8 |
| 2015/0345885 | A1 * | 12/2015 | Brown | F41A 17/38 42/6 |
| 2016/0169601 | A1 * | 6/2016 | Newman | F41A 17/38 42/6 |
| 2016/0273857 | A1 * | 9/2016 | Pettit | F41A 3/66 |
| 2016/0298918 | A1 * | 10/2016 | Baker | F41A 9/65 |
| 2016/0334177 | A1 * | 11/2016 | Green | F41A 9/62 |

* cited by examiner

MEANS FOR SEMI-PERMANENTLY RETAINING THE MAGAZINE OF A SEMI-AUTOMATIC FIREARM

CROSS REFERENCE TO RELATED APPLICATIONS

Modern Sporting Rifle Design Modifications for Enhanced Public Safety—Disclosure #2; Provisional Patent Application Number 61/951,052; Filing Date Mar. 11, 2014

Modern Sporting Rifle Design Modifications for Enhanced Public Safety—Disclosure #3; Provisional Patent Application Number 61/973,981; Filing Date Apr. 2, 2014

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

TECHNICAL FIELD

The invention relates generally to semi-automatic firearms and more specifically to a means for semi-permanently retaining the magazine of a semi-automatic firearm, rendering in at least temporarily incapable of accepting a detachable magazine.

BACKGROUND OF THE INVENTION

Modern Sporting Rifles (MSR) based on the AR-10 and AR-15 platforms, firearms originally designed by Armalite, with calibers ranging from 0.22 to 0.308, are among the most popular firearms sold in the world today. These AR-platform MSRs, however, have come under increased public scrutiny recently as the result of several high profile shooting incidents. State legislatures in a number of states, most notably Connecticut and New York, have enacted tough new laws to curb the use of these rifles and limit the perceived danger to the public. These restrictions have generally focused on the possession and use of high capacity magazines and features such as pistol grips and flash suppressors that are closely associated with guns often referred to as assault weapons. Unfortunately, these provisions do little to physically prevent the use of high capacity magazines or, more importantly, modify the speed with which a shooter can swap out one low capacity magazine for another and resume firing. Thus, the opportunity for Law Enforcement or potential victims to respond, during periods when a deranged shooter is trying to reload and resume shooting, has not been substantially affected. Moreover, efforts to physically limit the number of rounds that can be loaded into a firearm have been generally ineffective. Yes, laws regulating the possession and use of high capacity magazines (more than 10 rounds) have been passed, but higher capacity magazines are easily obtainable and nothing physically prevents their use in standard MSRs.

Given that the public interest in owning MSRs is unlikely to diminish and the ready availability and ease of use of high capacity magazines, while now illegal in some states, has not really changed, another approach to limiting the lethality and negative impact on public health is needed.

The standard MSR is manufactured and sold in a configuration allowing it to accept a detachable magazine that can be removed and replaced in seconds. This process does not require disassembly of the action of the firearm.

What is needed are new designs which physically limit the use of high capacity magazines and/or slow the reloading process. Such design modifications could significantly enhance the public safety without unreasonably interfering with Second Amendment rights to bear arms. This combination of design modifications would create longer interruptions in the use of one of these weapons during a shooting spree and provide an opportunity for potential victims to escape or time for others to rush in and overwhelm the shooter.

BRIEF SUMMARY OF THE INVENTION

It is an object of the present invention to provide a means for converting a semi-automatic firearm from a configuration capable of readily and quickly accepting or exchanging a detachable magazine into a configuration which semi-permanently fixes the magazine and thereby temporarily renders the firearm incapable of accepting or exchanging a detachable magazine.

For the purpose of this summary and later descriptions, the terms "semi-permanent" or "semi-permanently" and "temporary" mean a configuration or state of being that requires special tools and/or disassembly of the action of the firearm and a period of time on the order of approximately 3-20 minutes, or more, to remove and exchange a magazine or modify the configuration to one capable of readily accepting a detachable magazine.

It is another purpose of the invention to optionally make it more difficult to reconfigure the firearm back to a standard configuration, i.e., to easily replace the standard magazine catch, magazine catch spring and magazine catch button so as to easily defeat the fixed magazine nature of the firearm "on demand."

It is another object of the invention to optionally modify the way a magazine is inserted into the receiver of the firearm such that certain (curved) high capacity magazines cannot be used.

It is another object of the invention to require that the magazine can only be removed and replaced when the firearm is in a disassembled state.

It is another object of the invention to optionally require that at least one other component (besides the magazine retention components) of the lower receiver be removed prior to the removal of the magazine.

It is another object of the invention that a magazine can only be loaded into the firearm when the magazine is empty.

It is another object of the invention to prevent the use of reloading aids such as stripper clips that would greatly speed up the loading of cartridges into the magazine.

It is another object of the invention to create a parts kit that can be used to quickly accomplish the conversion of the firearm to a semi-permanently fixed magazine configuration.

It is a purpose of the invention to significantly increase the amount of time required to reload a semi-automatic firearm.

It is another purpose of the invention to provide a strong visual cue to any observer when the firearm is out-of-service and being reloaded.

A standard semi-automatic AR-platform firearm contains a magazine catch assembly housed within various machined recesses within the lower receiver. A standard magazine catch assembly is comprised of a magazine catch, a magazine catch spring, and a magazine release button. The magazine catch consists of two ends which occur at a substantially right angle. One end is provided with screw threads. The other end is a substantially flat member with a small protrusion on one side distal to the threaded screw portion. The magazine catch assembly is installed into a recess in the lower receiver by first inserting the threaded end of the magazine catch into a through-hole in the receiver. The magazine catch spring is then placed over the threaded screw end of the magazine catch from the opposite side of the receiver. And finally, the magazine catch button is pushed into its recess, on top of the spring, and the threaded screw end of the magazine catch is threaded into the magazine catch button. When fully assembled, the flat end of the magazine catch, with its small protrusion, is nested into a slot which passes through the side wall of the magazine well. The small protrusion on this flat extends into the magazine well and is available to engage with a feature on the side wall of the magazine to hold it in place. Once a magazine is inserted into the magazine well, and the protrusion on the magazine catch slides into the recess in the magazine, the magazine is held in place until the user releases the magazine by pushing the magazine release button. When the magazine release button is depressed, the magazine catch is lifted from the recess in the magazine wall and the magazine freely slides out of the magazine well.

A standard lower receiver has a magazine well with a uniform profile in cross-section from top to bottom of the well, typically achieved by passing a broaching tool through the entire length of the magazine well. The standard profile hence incorporates a full-length clearance slot along the side to allow easy passage of a raised portion on the side of the magazine which is designed to interact with the magazine catch.

The present invention is an alternative design for the lower receiver which can be substituted for the standard lower receiver of an AR-platform firearm. The invention maintains every current function of the standard lower receiver except the ability to quickly load and unload magazines into the magazine well. In its geometry, the alternative design is identical in all aspects to the standard lower receiver except that it preferably omits the slot, hole and machined recess which would normally accommodate the magazine catch, spring and magazine release button hardware respectively as described above.

In accordance with one embodiment of the present invention, the magazine is semi-permanently attached to the lower receiver using a retention screw and a retention fitting. To accommodate the fitting, the lower receiver is manufactured with a hole through the side wall of the magazine well in the same general location as the slot in the standard version. The retention fitting is held in place by a retention screw and loosely engages the magazine, passing through the recess in the magazine from the inside to the outside, and bearing on its inside surface of the magazine. In another embodiment of the present invention, the retention screw is replaced by a rivet to more permanently attach the magazine to the lower receiver. In a third embodiment of the invention, the fitting does not have threads or a hole to accommodate a screw or rivet, but is actually designed to function itself like a special rivet, having an elongated cylindrical section whose end can be deformed to prevent being withdrawn once it is fully installed. In accordance with all three of these embodiments of the invention, the fitting can only be installed when the magazine is empty and the magazine follower has been retracted to allow access to the recess in the side of the magazine from the inside surface. Retraction of the magazine follower can occur either by using special tools to compress the magazine follower spring and hold the magazine follower in the retracted position or by removing the bottom plate of the magazine, removing the follower spring, and lowering the magazine follower once all spring pressure has been removed.

In accordance with another embodiment of the present invention, the magazine well is modified to allow magazines to be inserted only from the top of the lower receiver. This is accomplished by interrupting the full-length clearance slot along the side by one of two ways. Option one is to avoid removing the material at the bottom of the slot during magazine well forming. Option two is to fill the bottom of the slot after it is formed. The first option can be achieved, for example, by broaching or using a wire edm process to form the well without the required clearance slot and then secondarily machining away the upper portion of the slot. The second option can be achieved by broaching or using a wire edm process to form the well with the a full-length clearance slot and then filling the bottom of the slot with a metal plug or other insert generally conforming to the slot geometry while not interfering with travel of the magazine follower or follower spring.

DETAILED DESCRIPTION OF THE INVENTION

Figure 1:
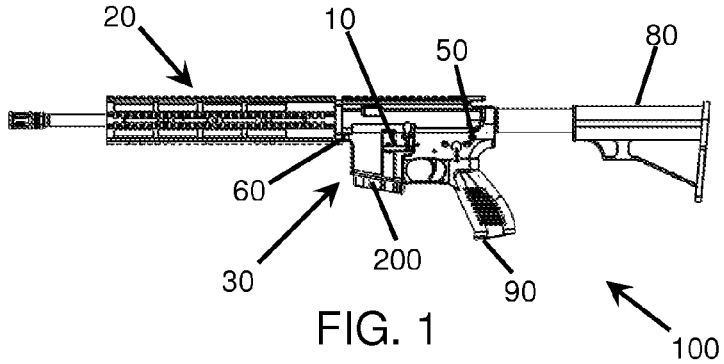
FIG. 1 is a side view of a firearm typical of a standard original equipment manufacturer (OEM) product capable of accepting a detachable magazine.

Since the basic firearm is of a well-known type, only those parts of the firearm essential to an understanding of the invention will be described in detail. Although the present invention will be described with reference to the exemplary embodiments shown in the drawings, it should be understood that the present invention can be embodied in many alternate forms or embodiments. In addition, any suitable size, shape or type of elements or materials could be used.

Figure 2:
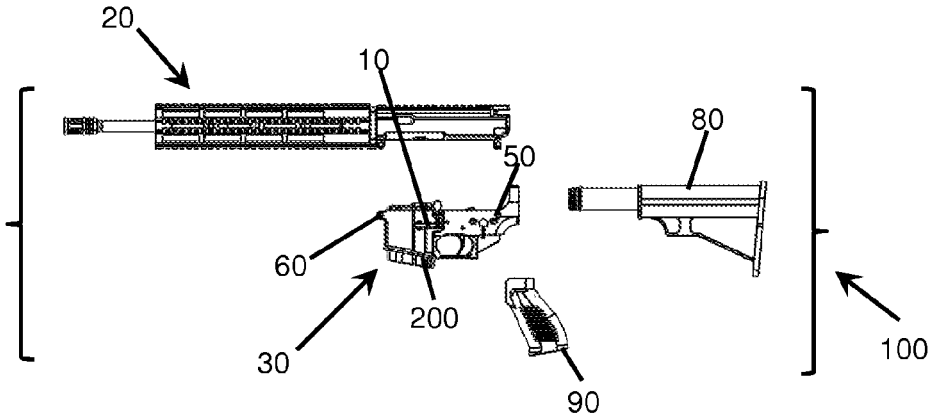
FIG. 2 is an exploded side view of the same firearm shown in FIG. 1 broken down into major component groups.
Figure 3:
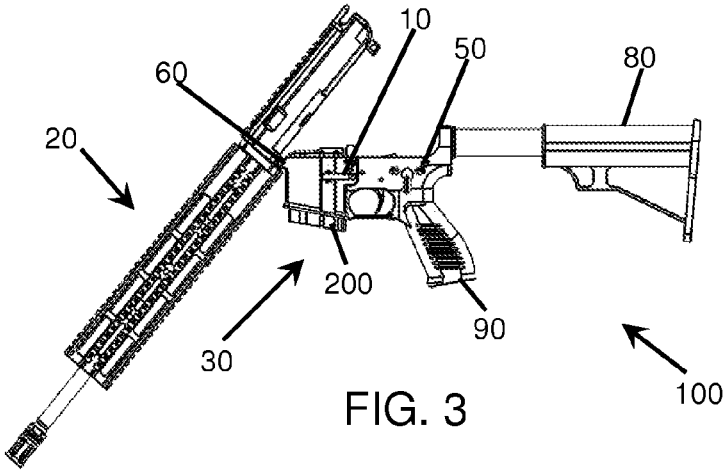
FIG. 3 is a side view of the same firearm shown in FIG. 1 with the upper receiver assembly rotated forward on the front pivot pin.

Referring to FIGS. 1-3 the standard firearm 100, capable of accepting a detachable magazine 200, is comprised of an upper receiver assembly 20 and a standard lower receiver assembly 30. As shown in FIG. 2 the standard lower receiver assembly 30 comprises partially a stock assembly 80 and a pistol grip 90. Note: subsequent drawings described for this invention will show the standard lower receiver assembly 30 exclusive of the stock assembly 80 or the pistol grip 90 for clarity. As shown in FIG. 3 the upper receiver assembly 20 and the standard lower receiver assembly 30 can scissor open when the rear takedown pin 50 is removed, allowing the upper receiver assembly 20 to be pivoted at the point of the pivot pin 60. FIGS. 1-3 show the standard configuration of the firearm 100, i.e., one capable of accepting a detachable magazine 200.

Figure 4:
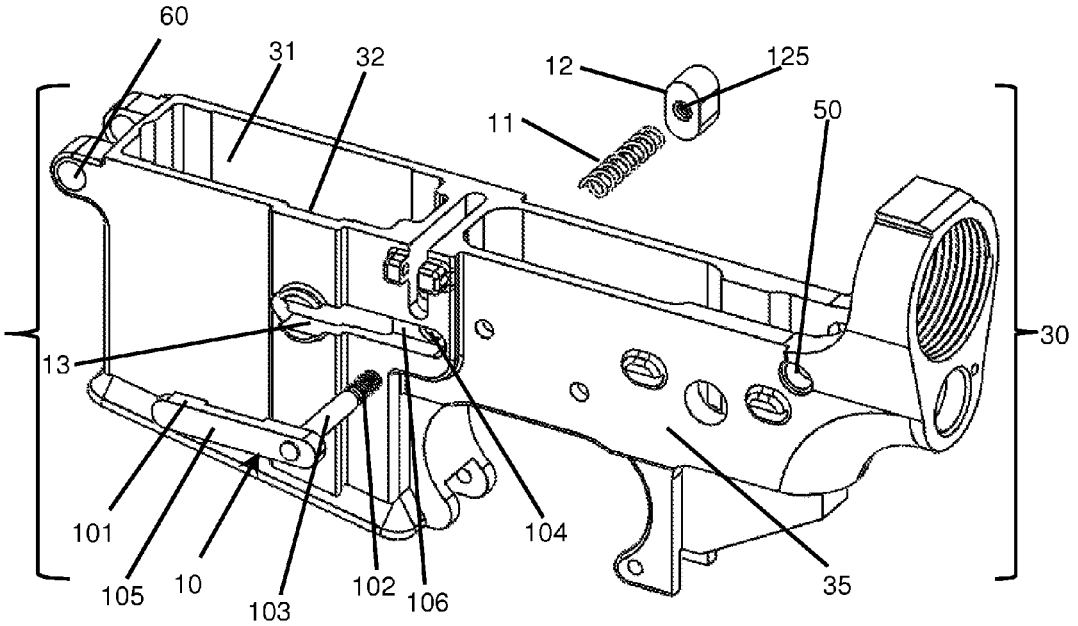
FIG. 4 is an exploded view of a standard lower receiver showing only the components associated with retaining and releasing a detachable magazine.
Figure 16:
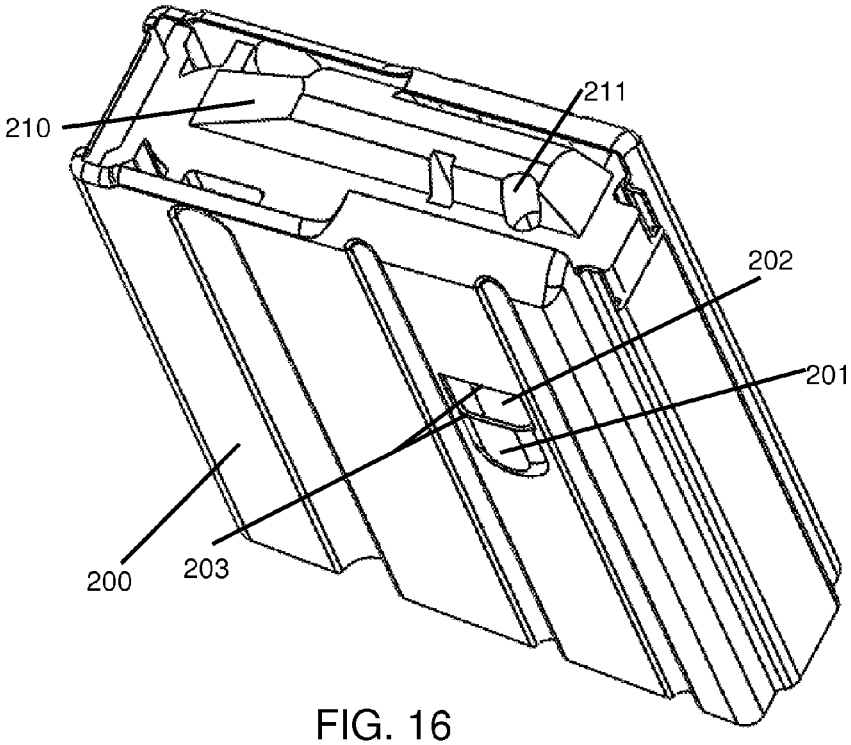
FIG. 16 is a perspective view of a typical magazine that has been slightly modified (by the addition of a drilled hole in the magazine follower) for easier installation in the lower receiver of the present invention.
Figure 17:
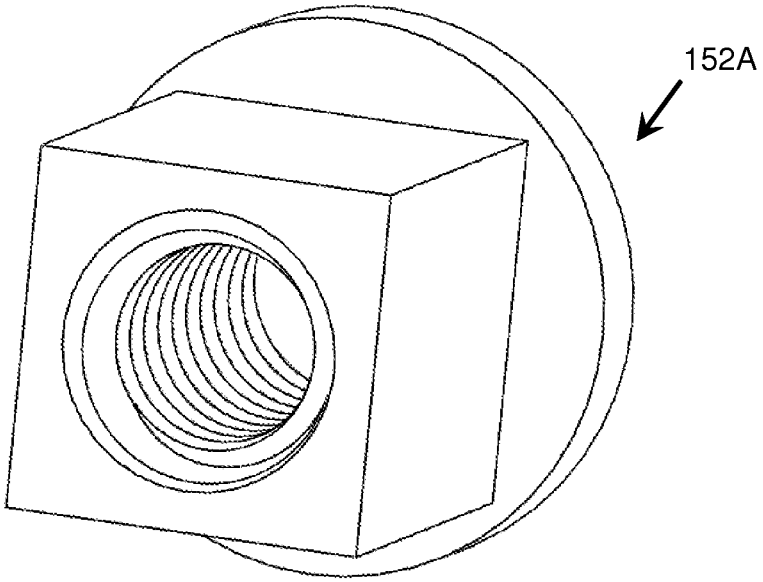
FIG. 17 is a perspective view of one embodiment of an alternative retention fitting that could be used to retain a magazine in a standard lower receiver.
Figure 18:
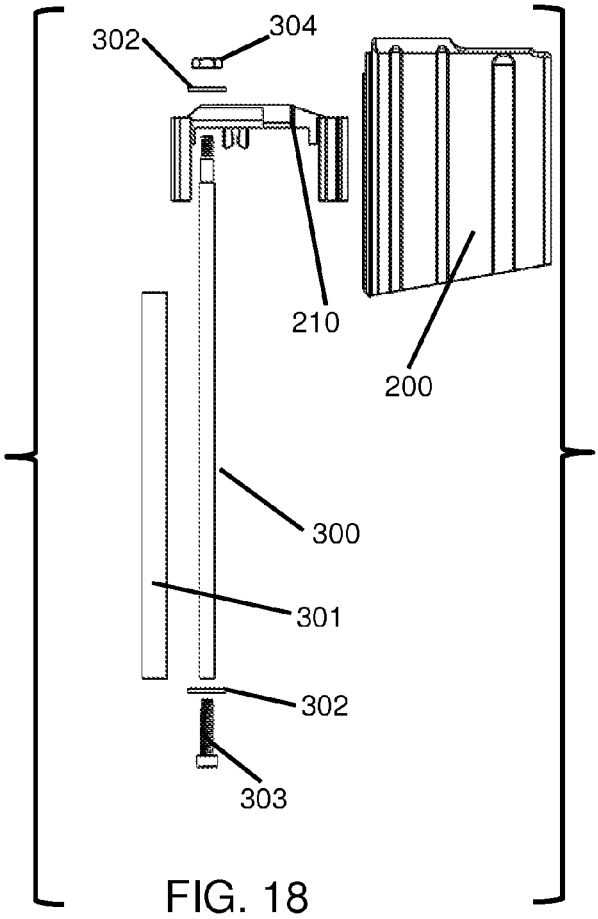
FIG. 18 is an exploded view of a magazine and follower along with special tooling that can be used to retract the follower for easier installation of the magazine retention fitting.
Figure 19:
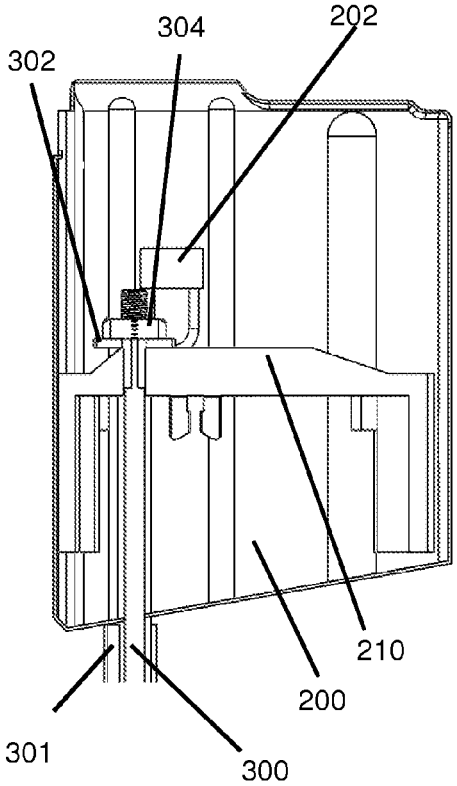
FIG. 19 is an enlarged sectional view of a magazine and follower showing how the special tooling described for FIG. 18 engages the follower.

Referring to exploded view FIG. 4 and FIG. 16, the standard lower receiver assembly 30 comprises partially a standard lower receiver 35, a magazine catch 10, a magazine catch spring 11, a magazine release button 12, and a magazine well 31. When fully assembled, the threads 102 of the magazine catch 10 engage with the threads 125 of the magazine release button 12. The circular end 103 of the magazine catch 10 passes through hole 104 in the standard lower receiver 35, then through the magazine catch spring 11 which forcibly biases the magazine catch 10 toward the bottom 106 of slot 13. When magazine catch 10 is properly aligned, the flat end 105 of the magazine catch 10 aligns with and is nested into slot 13 in the standard lower receiver 35. When a magazine 200 is installed in the magazine well 31, the protrusion 101 on the flat end 105 of the magazine catch 10 nests into the opening 202 of the magazine 200 and the edges of the protrusion 101 of the flat end 105 of the magazine catch 10 bears on the edges 203 of opening 202 of magazine 200, holding it firmly in place within the magazine well 31.

Figure 5:
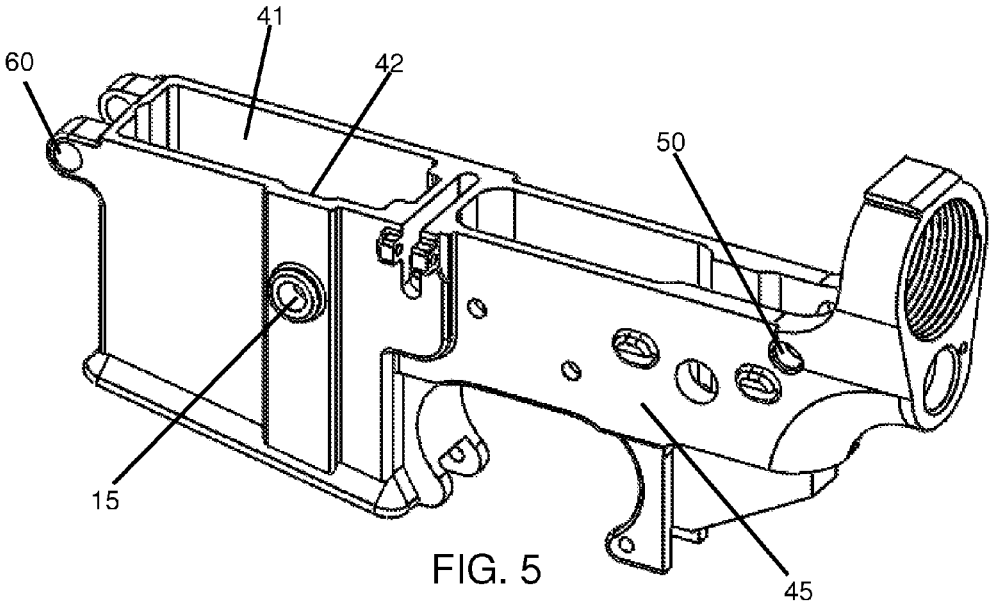
FIG. 5 is a perspective view of the top and left sides of an alternative lower receiver embodying the features of the present invention for semi-permanently fixing a magazine.

Referring to FIGS. 4 and 5, an alternative lower receiver 45 is shown for comparison with the standard lower receiver 35. This alternative lower receiver 45 is one embodiment of the lower receiver for the present invention. The key difference visible in these two views is the presence of the hole 15 in the alternative lower receiver 45 in lieu of the slot 13 in the standard lower receiver 35.

Figure 6:
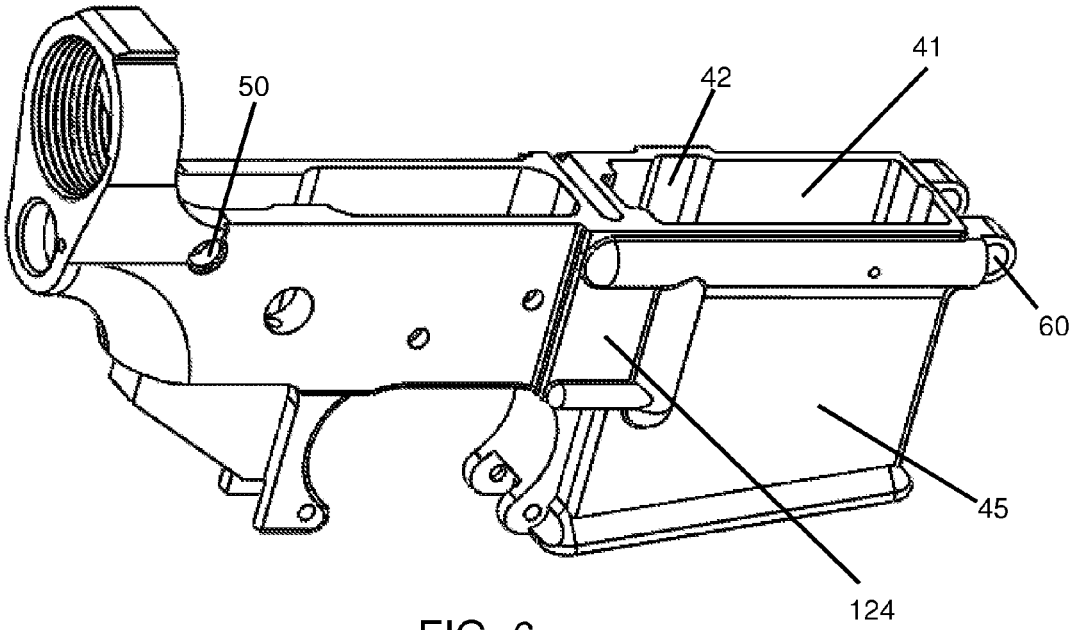
FIG. 6 is a perspective view of the top and right sides of an alternative lower receiver embodying the features of the present invention for semi-permanently fixing a magazine.
Figure 7:
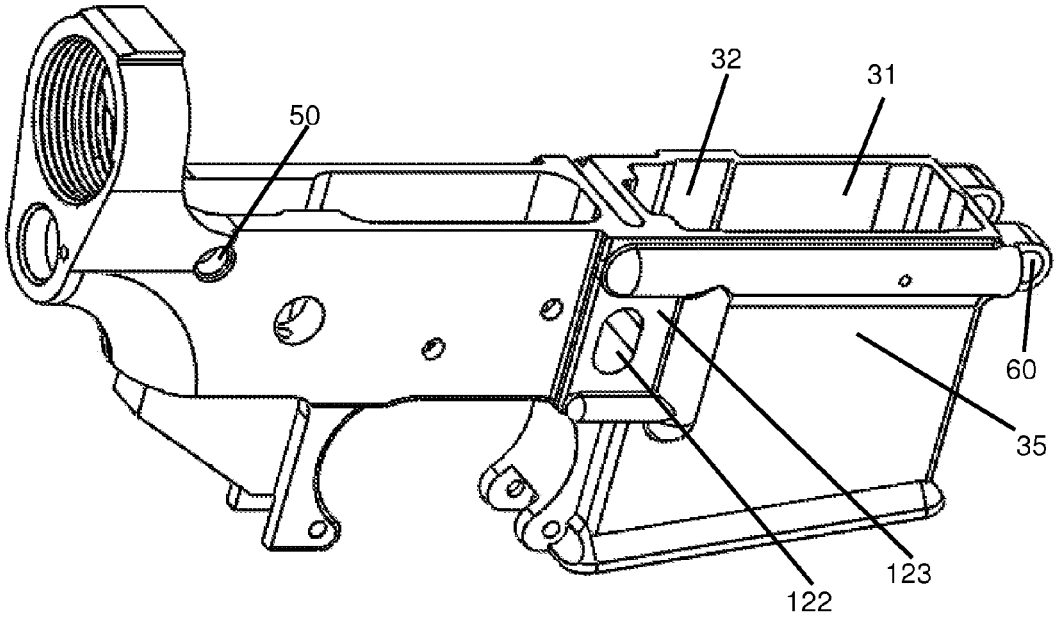
FIG. 7 is a perspective view of the top and right sides of a standard lower receiver designed for retaining and releasing a detachable magazine.

Referring to FIGS. 4, 6 and 7, the key difference visible in FIGS. 6 and 7 is the absence of the oval recess 122 present in face 123 of the standard lower receiver 35 but not present in face 124 of alternative lower receiver 45. As should be apparent, the through hole 104 of FIG. 4, as well as a recess/counterbore (not shown) for the magazine catch spring 11, are also omitted in alternative lower receiver 45.

Referring to the exploded view in FIG. 8 and FIGS. 14, 15 and 16, the alternative lower receiver assembly 40 is partially comprised of the alternative lower receiver 45, a fixed magazine 200, magazine follower 210, magazine retention screw 151, magazine retention fitting 152, bolt catch 120, and bolt catch pivot screw 121. When fully assembled, magazine 200 is positioned inside of the magazine well 41 of the alternative lower receiver 45. Magazine 200 is primarily held in place by magazine retention fitting 152. Magazine retention fitting 152 is designed to pass through opening 202 in magazine 200, from the inside of magazine 200 outward. Once installed, the flat edges 155 of magazine retention fitting 152 bear against the upper and lower surfaces 203 of opening 202, the flat face 153 of magazine retention fitting 152 bears against the inside wall of magazine 200, and the cylindrical face 154 of magazine retention fitting 152 is concentrically aligned with and passes through hole 15 of the alternative lower receiver 45. The length of the cylindrical face 154 is configured to be long enough that the magazine retention fitting does not bear forcibly against the inside wall of magazine 200 once flat face 156 of magazine retention fitting 152 makes contact with the bearing face 159 of magazine retention screw 151, after the screw threads 158 of magazine retention screw 151 have fully engaged the screw threads 157 of magazine retention fitting 152. At the same time, the length of the cylindrical face 154 is configured to be short enough that the magazine retention fitting does interfere with the movement of the magazine follower 210 or the follower spring.

Figure 14:
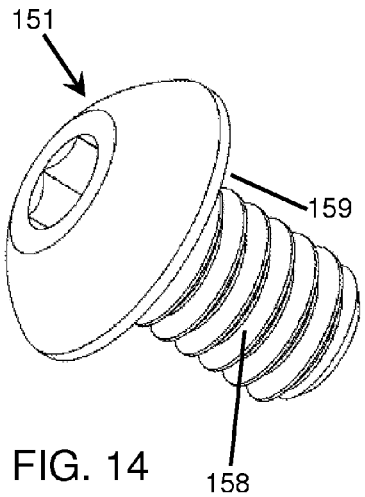
FIG. 14 is a perspective view of one embodiment of the retention screw used in the present invention.

The method of capturing the magazine retention fitting 152 described above involves use of a magazine retention screw 151. In FIG. 14 this screw is illustrated as a button head screw suitable for use with a hexagonal drive wrench. Alternatively, the magazine retention fitting 152, could be captured using a screw of any other configuration (torx, phillips, slotted), an anti-tamper screw that cannot be easily unscrewed, or even a rivet and washer. These options give the producer of this invention some flexibility in the degree of permanence of fixing the magazine 200 in place. Alternatively, the magazine retention fitting 152 could be fabricated with an elongated cylindrical section 154 and, omitting the through-hole and threads, be configured as a custom-shaped rivet. This custom rivet could be installed as described for the current magazine retention fitting 152 from the inside of the magazine 200 and then have the outside cylindrical face 156 deformed as is typically done with a rivet with the deformation occurring on the outside of the alternative lower receiver 45 once the rivet end has passed through hole 15. This deformation would most permanently install retention fitting 152 and magazine 200 such that the retention fitting 152 would have to be destroyed to remove magazine 200.

Figure 12:
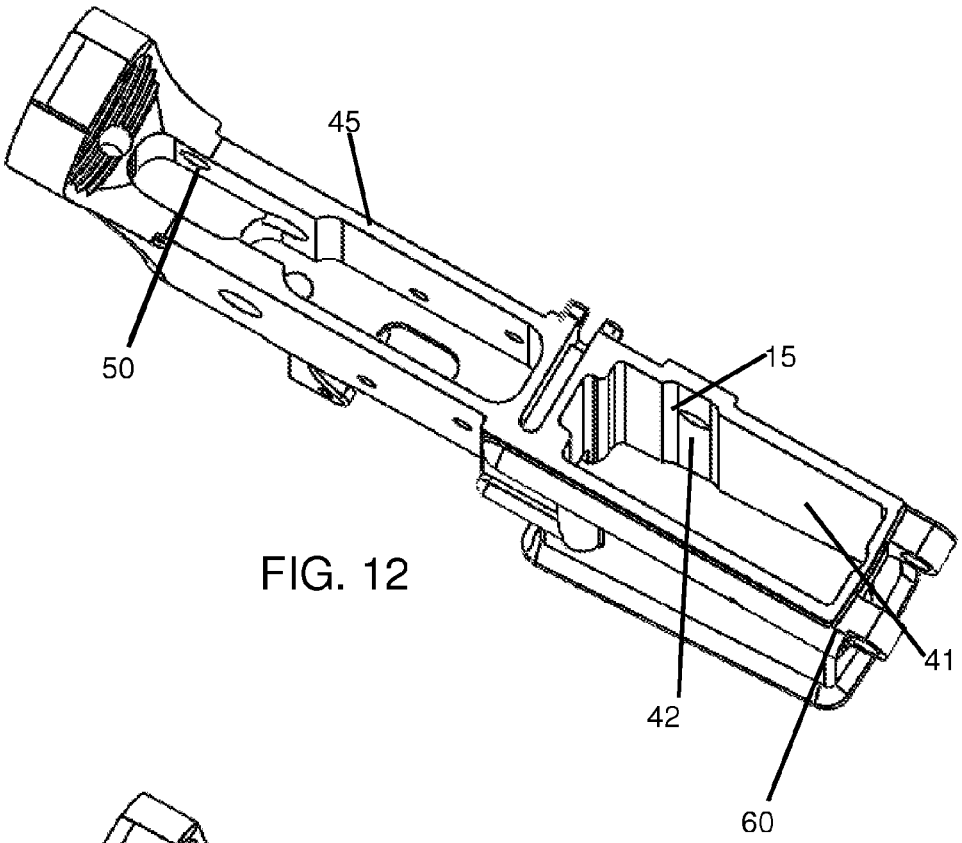
FIG. 12 is a perspective view showing details of the magazine well geometry for an alternative lower receiver of the present invention with an uninterrupted clearance slot.
Figure 13:
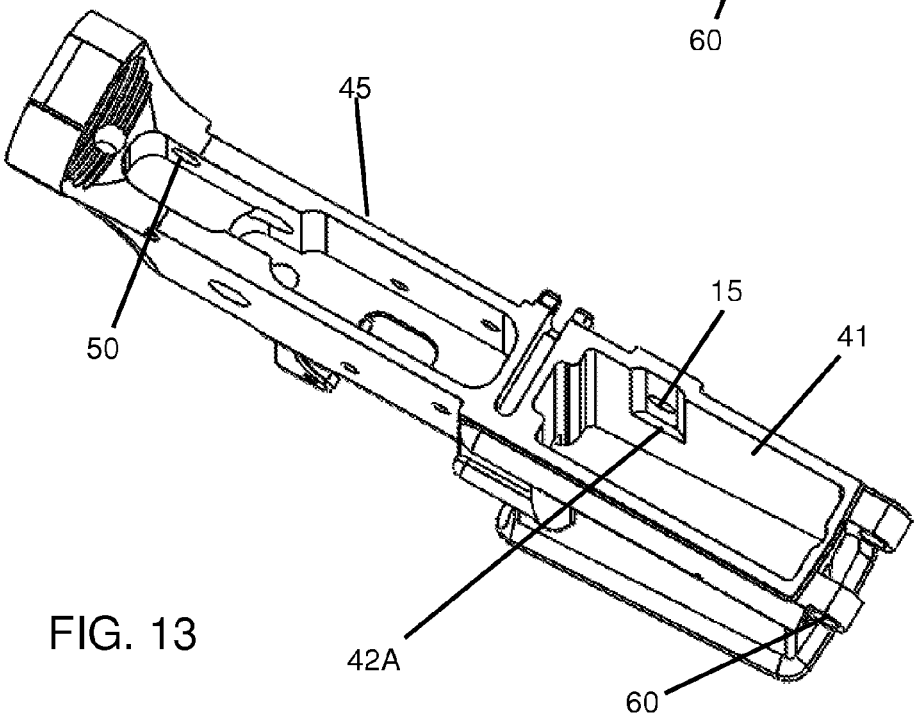
FIG. 13 is a perspective view showing details of the magazine well for the alternative lower receiver with an interrupted clearance slot.

Referring to FIGS. 9, 10, 12 and 13, notice that bolt catch 120 overlaps and is pushed up by magazine follower 210 when there are no cartridges in the magazine. Also note that bolt catch 120 will prevent magazine 200 from being removed vertically upward from the alternative lower receiver 45. When combined with the interrupted clearance slot 42A embodiment of magazine well 41 as shown in FIG. 13, it should be obvious that magazine 200 can only be removed from the alternative lower receiver 45 after first removing both the magazine retention screw 151 and removing the bolt catch 120. Similarly, it should be obvious that inserting and securing magazine 200 can only be done before the bolt catch 120 is installed into the alternative lower receiver assembly 40. If, alternatively, the present invention is produced with an uninterrupted clearance slot 42 as shown in FIG. 12, the magazine 200 can be inserted from the bottom of magazine well 41 and it is unnecessary to remove bolt catch 120 to accomplish insertion.

Figure 8:
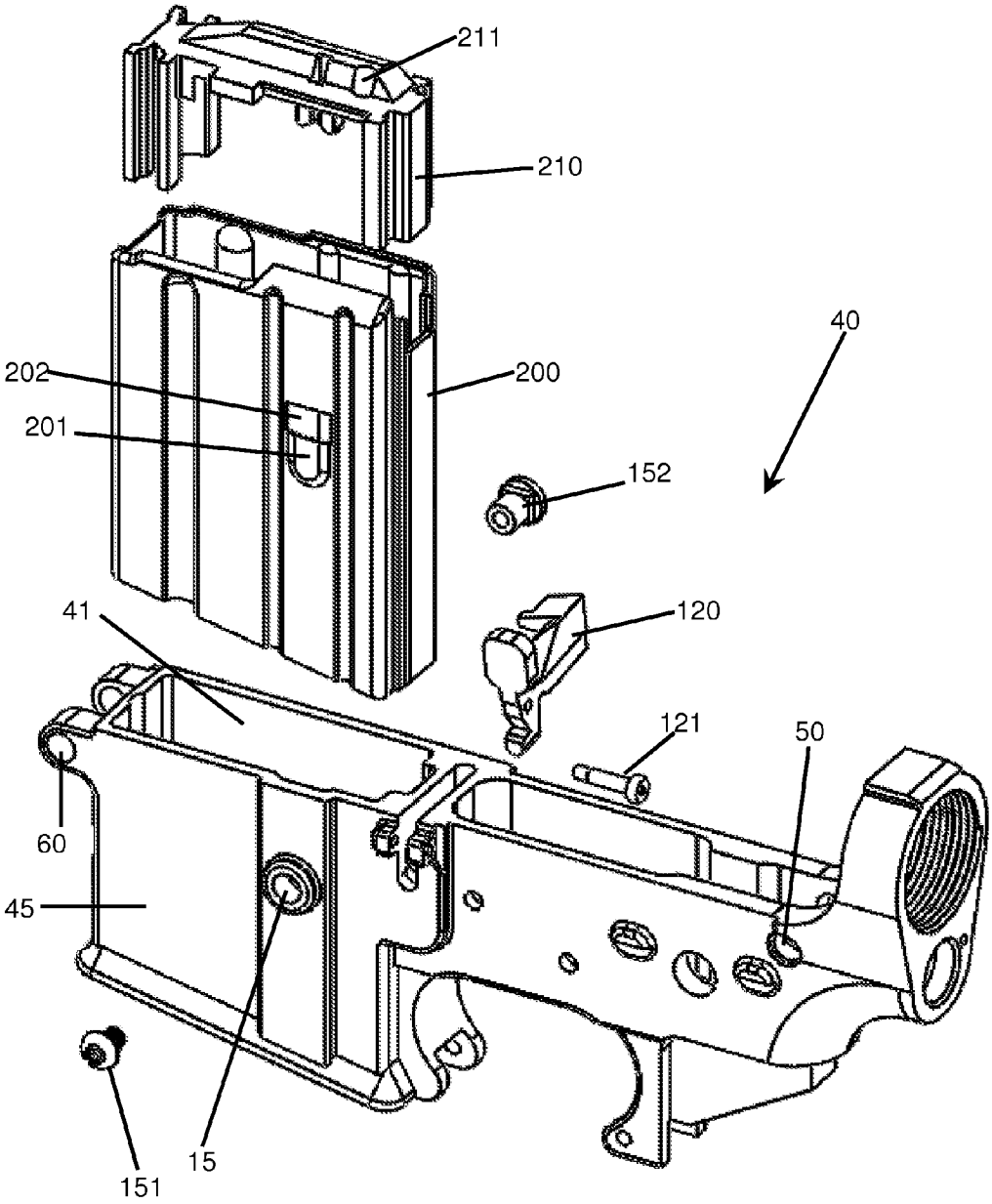
FIG. 8 is an exploded perspective view of the top and left sides of an alternative lower receiver assembly embodying the features of the present invention for semi-permanently fixing a magazine including the magazine and components involved in semi-permanently retaining the magazine.
Figure 9:
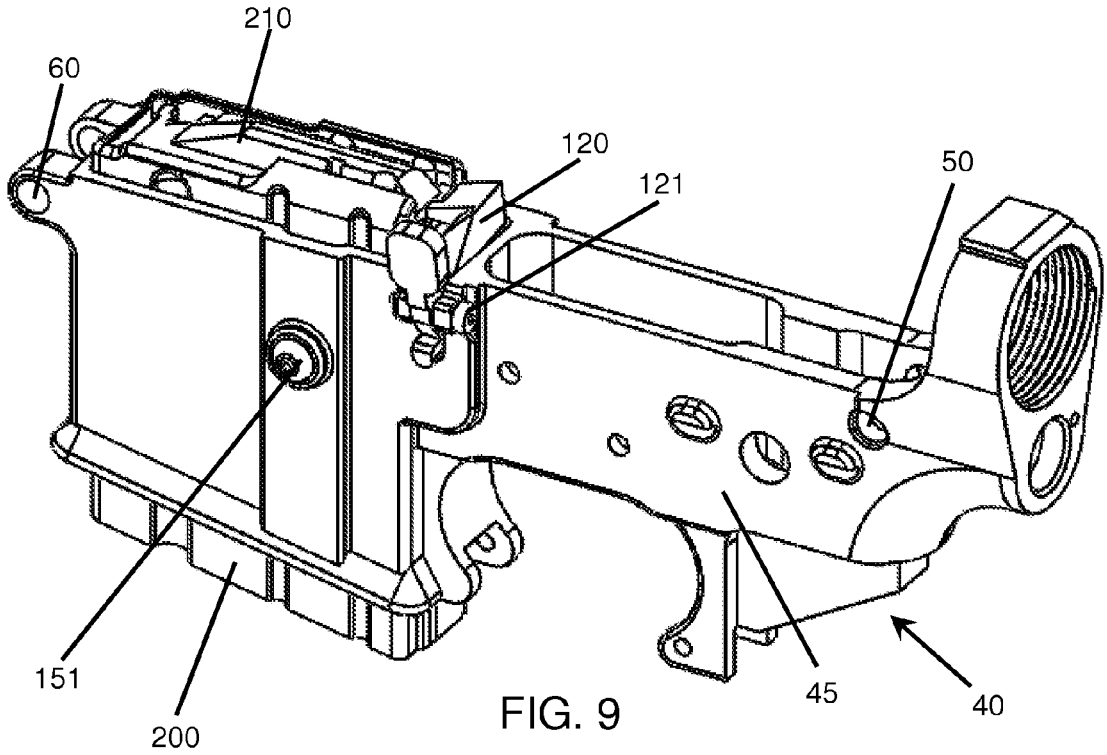
FIG. 9 is a perspective view with the various components shown in FIG. 8 collapsed into their normal position.
Figure 10:
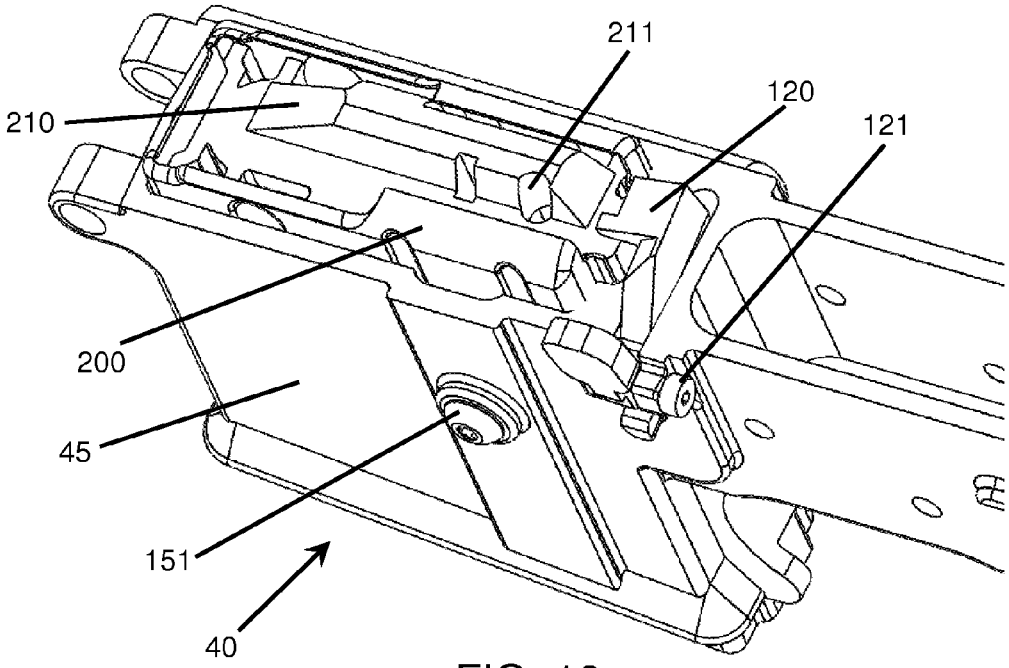
FIG. 10 is a close-up of the view shown in FIG. 9, but also showing some details on the top of the magazine that were not clearly visible in FIG. 9.
Figure 11:
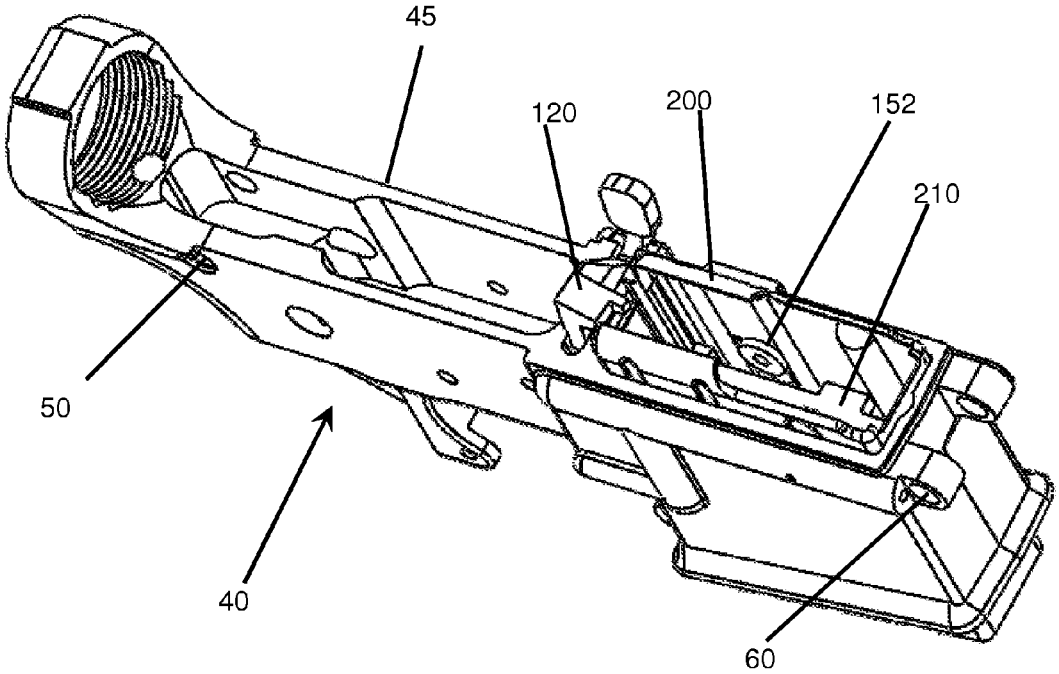
FIG. 11 is a perspective view of an alternative lower receiver assembly with the magazine follower retracted so the magazine retention fitting is visible.
Figure 15:
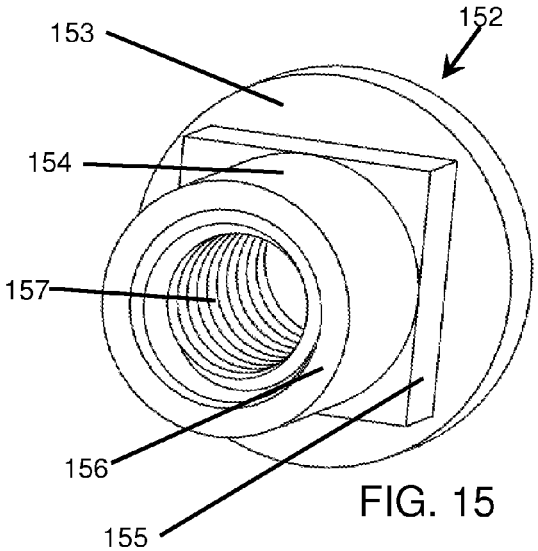
FIG. 15 is a perspective view of one embodiment of the retention fitting used in the present invention.

Referring to FIGS. 8, 11 and 15, the position of magazine retention fitting 152 is shown in its installed position in FIG. 11 inside magazine 200. Notice that to install magazine retention fitting 152, the magazine 200 must be empty of any cartridges and the magazine follower 210 must be displaced downward to make access to hole 15 in alternative lower receiver 45 possible. In practice, installation of the magazine retention fitting 152 could be done, but with great difficulty, without special tools. To make this task easier, various special tools to retract and hold magazine follower 210 (against spring pressure from a magazine follower spring—not shown) in its retracted position inside magazine 200 and then load and position magazine retention fitting 152 through opening 202 and hole 15, prove to be very helpful. Also note in FIG. 11 that the thickness of the circular section of magazine retention fitting 152 defined by face 153 and its outward opposite face must be thin enough that the magazine follower 210 is not impeded as the magazine follower 210 cycles up and down inside magazine 200 as cartridges are loaded and removed.

Referring to FIGS. 3, 4, 7, 12, 13, 15, 16 and 17, the clearance slot can be created in two configurations: the interrupted geometry of clearance slot 42A clearly differs from the constant section properties of clearance slot 42. It is this interrupted geometry of clearance slot 42A that creates one embodiment of the present invention as it interferes with the raised boss 201 on magazine 200 and prevents magazine 200 from being loaded into the magazine well 41 from the bottom as is the normal practice for firearms of this general type. This feature also effectively prevents the use of any curved magazine, often referred to as a "banana" magazine, since passing such a curved magazine through the entire magazine well from the top to properly seat the magazine, however it is retained, is not possible. Many, but not all, high capacity magazines have this curved profile and therefore cannot be used with this embodiment of the invention. A second embodiment of the present invention is created if the clearance slot is not interrupted as shown by clearance slot 42. In this case the magazine 200 can be loaded into the magazine well 41 from the bottom. So long, however, as the magazine 200 is retained semi-permanently using, for example, the method described involving a magazine retention screw 151 and a magazine retention fitting 152 or 152A, the objective of this invention to semi-permanently fix the magazine 200 is maintained.

The interrupted clearance slot 42A embodiment of this invention can be achieved in two general ways. In one approach to this embodiment, the interrupted clearance slot 42A is created by preferentially removing material from the upper half of the wall of the magazine well 41 of the alternative lower receiver 45, by using, for example, an end mill to machine the material away. Other methods such as electronic discharge machining (EDM) or partial broaching might also be used. The specific method is not important—any suitable material removal process is acceptable so long as it results in removal of material over approximately the top half of the slot only. The other approach to this embodiment for creating an interrupted clearance slot 42A is achieved by adding material to the bottom half of the wall of the alternative lower receiver 45 after a full-depth clearance slot 42 is first created. One likely means of creating this full-depth clearance slot is the broaching method used to manufacture most firearms of this type today. The added material could, for example, be in the form of a flat plug contoured to fit into the clearance slot 42 without interfering with the insertion of a magazine 200 thereafter. This flat plug could be secured in place by a variety of means such as, for example, one or more screws, one or more rivets, an adhesive such as epoxy adhesive, a combination of mechanical and adhesive means, or by even more permanent methods such as vibration or friction welding. The method is not important so long as it effectively prevents a magazine 200 from being inserted from the bottom of the alternative lower receiver 45.

For the present invention, to load cartridges into the firearm and make it operational in a semi-automatic configuration, it is first necessary to install a magazine 200. This magazine must be empty to be installed so magazine retention fittings 152 or 152A can be properly located and aligned to engage with hole 15 in the alternative lower receiver 45 or slot 13 in the standard lower receiver 35. Depending on how far forward the upper receiver assembly 20 can be scissored open, it may be necessary to fully remove the upper receiver assembly 20 for this step. In any case, and at a minimum, the upper and lower receiver assemblies, 20 and 30 or 40, must be separated at the rear end of the lower receiver by disengaging the takedown pin 50 from its normally seated location. A second necessary step in the installation of this magazine 200, applicable only for the interrupted clearance slot 42A embodiment requiring loading of the magazine 200 from the top of the alternative lower receiver 45, is the removal of the bolt catch 120, which otherwise blocks access to magazine well 41 of the alternative lower receiver 45. Once the bolt catch 120 is removed, magazine 200 can be slid into magazine well 41 from the top of the alternative lower receiver 45. For the uninterrupted clearance slot 42 embodiment, removal of bolt catch 120 is not required and the magazine 200 can be inserted into magazine well 31 or 41 from the bottom of the well. In either case, the next step is preferably using a special tool to retract the magazine follower 210 to make opening 202 accessible and another special tool to easily carry and align magazine retention fitting 152 or 152A into hole 15 or slot 13 respectively, so magazine retention screw 151 (or another means of fixation) can be engaged into the magazine retention screw 152 or 152A to affix it in place. Fully tightening a magazine retention screw 151 requires preventing rotation of the magazine retention fitting 152 while the magazine retention screw 151 is fully seated into the magazine retention fitting 152. This is easily accomplished when the flat faces 155 of the magazine retention fitting 152 are aligned with and pass through the faces 203 of opening 202 of magazine 200. Once the magazine retention screw 151 and magazine retention fitting 152 are fully seated so surface 159 bears on surface 156, or the retention fitting is otherwise affixed, the bolt catch 120 and bolt catch pivot screw 121 can be installed (if they were necessarily removed beforehand). This task is also easier, but can be done otherwise, if the magazine follower 210 is retracted. Once the bolt catch 120 is installed, the magazine follower 210 can be released, any special tooling removed, and the magazine is ready to be loaded with cartridges.

Cartridge loading of this fixed magazine firearm can only take place with the upper receiver assembly 20 scissored open from the lower receiver assembly 30 or 40. Assuming normal dimensions and tolerances specified in most designs for the magazine well, the clearances between the magazine well 31 or 41 and the magazine 200 are too small to allow insertion of a device known as a stripper clip guide—a means to facilitate rapidly loading multiple cartridges that have been preloaded into a special clip to quickly fill the magazine 200. When the magazine has been loaded with as many cartridges as the shooter wishes to load, up to its maximum capacity, the upper receiver assembly 20 is rotated back into its normal operational configuration and the takedown pin 50 is reinstalled.

For this invention, it is only envisioned that the magazine 200 would be removed from the alternative lower receiver 45 to facilitate cleaning or to replace a magazine that has become excessively worn or damaged. The process of removal and replacement of a magazine 200 is preferably done in an area where sufficient lighting and the special tools noted are available and where small components can be easily handled without risk of getting lost. In practice, while it may be done faster with a highly experienced user, the time to remove and replace a magazine 200, given the embodiment of alternative lower receiver 45 and an interrupted clearance slot 42A, is typically in the range of 3-5 minutes.

Since removal and replacement of the magazine 200 could occur multiple times over the life of a firearm, and since removal and replacement of the magazine 200 requires removal and replacement of the bolt catch 120 for the embodiment incorporating the interrupted clearance slot 42A, the means for securing the bolt catch 120 for this embodiment has been described as installing a bolt catch pivot screw 121. Use of this bolt catch pivot screw 121 is in lieu of using a more permanent spring pin as might be more common for the uninterrupted clearance slot 42 embodiment where magazine 200 can be loaded from the bottom of the magazine well 31 or 41. Spring pins, by their nature, rely on an interference fit between the pin and the hole(s) it is inserted into, said interference being accommodated by the ability of the spring pin to slightly flex diametrically. This approach, using a spring pin, would be problematic if periodic removal of the bolt catch 120 was needed because frequent removal and replacement of this spring pin, necessary for removing and replacing the bolt catch 120, would cause wear and possible other damage to the lower receiver as it is forced in an out of the mating holes used to position the bolt catch 120.

Referring to FIGS. 11, 16, 18 and 19, the small hole 211 in magazine follower 210 is a modification intended to make the retraction of the follower easier. One means of retracting magazine follower 210 is through the use of special tooling comprising a rod 300 (typical of the rods used for cleaning the inside surface of a rifled barrel) with male threads on one end and female threads on the other, a retraction spacer 301, two flat washers 302, a machine screw 303 and a nut 304. Using this tooling, the rod 300 is passed through a hole in the bottom of the magazine 200 and then through hole 211 in magazine follower 210. Once in position, the rod can be secured in place using the screw 303, the two flat washers 302 and the nut 304 as shown. Then using the rod 300 as a means for pulling on the magazine follower 210 against the follower spring (not shown), the magazine follower 210 can be retracted into the magazine 200 and the rod 300 secured temporarily in this position using retraction spacer 301. With a properly sized retraction spacer 301, the magazine follower 210 will be retracted sufficiently to make opening 202 accessible to the magazine retention fitting 152. Once magazine 200 is secured into the magazine well 41 of the alternative lower receiver 45, the bolt catch 120 can be installed while the magazine follower 210 is still retracted. Once installation of the bolt catch 120 is complete, the retraction spacer 301 can be removed, the magazine follower 210 can be allowed to return to its fully extended position, nut 304 and its associated washer 302 can be removed, and rod 300 can be withdrawn.

Referring to FIGS. 4, 15, 16 and 17, alternate retention fitting 152A is designed to semi-permanently fix the magazine in a standard lower receiver 35. The rectangular section of retention fitting 152 defined by sides 155 has been extended by an additional length equivalent to the length of the cylindrical section defined by sides 154 for retention fitting 152 such that the rectangular section aligns with and slideingly passes through both the opening 202 in magazine 200 and the magazine catch slot 13 of a standard lower receiver 35. The overall length of retention fittings 152 and 152A is thus the same. While this embodiment of the retention fitting would allow the lower receiver to be reconfigured back to its original capability for accepting a detachable magazine 200, the level of effort and time to do so could be controlled by the means of affixing the modified retention fitting 152A into the standard lower receiver 35. For example, if the modified retention fitting 152A were configured as a deformable rivet, reverting to a configuration capable of readily accepting a detachable magazine would require grinding, filing or drilling away the deformed head of the retention fitting, a process that would require at least several minutes and would be an obvious (and potentially illegal) modification when completed. Similarly, use of an anti-tamper screw, one which can be easily installed, but is very difficult to remove, would make the conversion process time consuming and require special tools.

Referring to FIGS. 4, 9, 10 and 15, the alternative lower receiver 45, the magazine assembly 200, a retention screw (or rivet) 151, a retention fitting 152, and a bolt catch pivot screw 121 can be included together in a parts kit, with or without a standard Lower Parts Kit (a commercially available group of components including, for example, a hammer, trigger, a connector, bolt catch, various pins and springs—not shown in any of the FIGS., but well known in the industry), to create an alternative lower receiver assembly 40 that can be easily substituted for a standard lower receiver assembly 30.

The invention claimed is:

1. A firearm adapted to include a semi-permanently fixed magazine, comprising:

a lower receiver having a magazine well configured to receive the magazine, said magazine well further defining a through-hole positioned on a sidewall thereof; and a magazine defining at least one through-hole positioned on a sidewall thereof; and a retention fitting for being inserted into the through hole of the magazine;

wherein the retention fitting is configured to be substantially aligned with the through hole of said magazine well when the magazine is received thereby;

passes through the magazine and the sidewall of the magazine well to semi-permanently fix the magazine in the magazine well;

and comprises:

a first section sized to prevent passage of the retention fitting through the through-hole in the sidewall of the magazine, a second section, adjacent to the first section, sized to slidingly engage the through-hole in the sidewall of the magazine, and a third section, adjacent to the second section, sized to slidingly engage the through-hole in the sidewall of the magazine well of the lower receiver;

and wherein the second section further comprises a rectangular cross-section with a first cross-section dimension in the range of 0.22" to 0.25", a second cross-section dimension in the range of 0.22" to 0.375", and a length in the range of 0.06" to 0.1".

2. The firearm of claim 1, further comprising;

a retention screw, wherein said retention fitting is configured to include threading for receiving said retention screw such that the retention screw engages with the retention fitting to hold it in place in the magazine and semi-permanently fix the magazine in the magazine well.

3. The firearm of claim 1, further comprising;

a retention rivet, wherein said retention fitting is configured to include a through-hole for receiving said rivet such that the rivet engages with the retention fitting to hold it in place in the magazine and semi-permanently fix the magazine in the magazine well.

4. The firearm of claim 1, wherein:

the retention fitting is provided in the form of an elongated body configured to pass through the through-hole of the magazine and the through-hole of magazine well; and further wherein the elongated body is deformed like a head of a rivet to prevent the retention fitting from being withdrawn.

5. The firearm of claim 1, wherein:

the retention fitting is installed from inside of the magazine, passes through the through-hole on the sidewall of the magazine, and further passes through the through-hole in the sidewall of the lower receiver.

6. The firearm of claim 1, wherein:

the through-hole positioned on a sidewall of the lower receiver further comprises a round hole with a diameter in the range of 0.22" to 0.28".

7. The firearm of claim 1, wherein:

the through-hole positioned on a sidewall of the lower receiver further comprises a round hole which is positioned to align with the at least one through-hole positioned on a sidewall of the magazine when the magazine is properly positioned to load cartridges into the barrel chamber.

8. The firearm of claim 1, wherein:

the lower receiver further comprises side walls that do not have holes or other provisions designed to accommodate a standard magazine catch, magazine catch spring or magazine catch button.

9. The firearm of claim 1, wherein:

the lower receiver is a standard AR-platform lower receiver including any or all of the machined features needed for retention and functioning of a magazine catch, magazine catch spring, and magazine catch button.

10. The firearm of claim 1, wherein:

the first section further comprises a circular cross-section with a thickness in the range of 0.015" to 0.10" and a diameter in the range of 0.28" to 0.4".

11. The firearm of claim 1, wherein:

the third section further comprises a circular cross-section with a diameter in the range of 0.22" to 0.25" and a length in the range of 0.15" to 0.25".

12. The firearm of claim 1, wherein:

the third section is a continuation of the second section, similar in cross-section size and shape to the second section, and the overall length of the two sections together is in the range of 0.21" to 0.35".

13. The firearm of claim 1, wherein:

the first section further comprises a rectangular cross-section with a thickness in the range of 0.015" to 0.10" a first cross-section dimension in the range of 0.25"to 0.375" and a second cross-section dimension in the range of 0.30" to 0.5".

14. A method of semi-permanently fixing an ammunition magazine in the magazine well of a lower receiver of a firearm comprising:

the lower receiver having a magazine well configured to receive the magazine, said magazine well further defining a through-hole positioned on a sidewall thereof; and the magazine defining at least one through-hole positioned on a sidewall thereof;

and a retention fitting for being inserted into the through hole of the magazine;

wherein the retention fitting is configured to be substantially aligned with the through hole of said magazine well when the magazine is received thereby;

passes through the magazine and the sidewall of the magazine well to semi-permanently fix the magazine in the magazine well;

and comprises:

a first section sized to prevent passage of the retention fitting through the through-hole in the sidewall of the magazine, a second section, adjacent to the first section, sized to slidingly engage the through-hole in the sidewall of the magazine, and a third section, adjacent to the second section, sized to slidingly engage the through-hole in the sidewall of the magazine well of the lower receiver;

and wherein the second section further comprises a rectangular cross-section with a first cross-section dimension in the range of 0.22" to 0.25", a second cross-section dimension in the range of 0.22" to 0.375", and a length in the range of 0.06" to 0.1"

and further comprising the steps of:

inserting the magazine into the magazine well of the lower receiver in its normal orientation;

and aligning the through-hole positioned in the sidewall of the magazine well with the through-hole positioned in the sidewall of the magazine;

and inserting the retention fitting through the two said aligned holes, wherein the retention fitting is first positioned inside the magazine and the act of inserting the fitting through the two aligned holes proceeds from the inside of the magazine outward toward the outside of the magazine and to the outside of the lower receiver;

and securing the retention fitting in position.

15. The method of claim 14 wherein the retention fitting further comprises a threaded hole and is secured in position by:

screwing a threaded fastener into the retention fitting wherein the threaded fastener comprises a threaded portion sized for the threads in the retention fitting and a head portion which is large enough in diameter to prevent its passage through the through-hole in the sidewall of the magazine well of the lower receiver;

and restraining the retention fitting in place with its first section bearing against the inside face of the magazine and the sidewalls of its second section bearing against the sides of the opening in the wall of the magazine so as to prevent rotation during tightening;

and tightening the threaded fastener until the head of the fastener bears against the end of the retention fitting.

16. The method of claim 14 wherein the retention fitting further comprises a through-hole and is secured in position by:

passing one end of a rivet through the through-hole in the retention fitting wherein the rivet comprises:

a cylindrical body portion diametrically sized to slidingly pass through the hole in the retention fitting and of the correct grip length to allow expansion of the body portion of the rivet beyond the inboard end of the retention fitting;

and a head portion which is large enough in diameter to prevent its passage through the through-hole in the sidewall of the magazine well of the lower receiver;

and causing the head of the rivet to bear against the outer face of the retention fitting while maintaining the first section of the retention fitting in contact with the inside wall of the magazine;

and deforming the inboard end of the rivet such that it cannot be retracted through the through-hole in the retention fitting.

17. The method of claim 14 wherein the retention fitting further comprises an elongated body and is secured in position by:

holding the retention fitting in place with its first section bearing against the inside wall of the magazine;

and deforming the elongated end which extends beyond the outside face of the magazine well of the lower receiver sufficiently that the deformed end is too large to be retracted back through the through-hole in the sidewall of the magazine well.

* * * * *